United States Patent [19]

Bennett et al.

[11] 4,406,313

[45] Sep. 27, 1983

[54] METHOD AND APPARATUS FOR FILLING DISCRETE DRUMS WITH A LIQUID

[75] Inventors: Charles R. Bennett; Peter Guarner, both of Miami, Fla.

[73] Assignee: Texaco Inc., White Plains, N.Y.

[21] Appl. No.: 305,435

[22] Filed: Sep. 25, 1981

[51] Int. Cl.[3] ..... B65B 3/04

[52] U.S. Cl. ..... 141/1; 141/198; 141/286; 222/14

[58] Field of Search ..... 222/14; 141/286, 285, 141/94, 95, 192, 198, 1–12

[56] References Cited

U.S. PATENT DOCUMENTS

| | | | |
|---|---|---|---|
| Re. 29,495 | 12/1977 | Georgi | 222/14 |
| 2,832,643 | 4/1958 | Bletcher et al. | 141/286 |
| 3,460,590 | 8/1969 | Robbins | 141/286 |
| 4,105,138 | 8/1978 | Lehmann et al. | 222/14 |

*Primary Examiner*—Houston S. Bell, Jr.

*Attorney, Agent, or Firm*—Carl G. Ries; Robert A. Kulason; Robert B. Burns

[57] ABSTRACT

A system for repeatedly depositing equal volumes of liquid from a pressurized source of the latter into a series of drums. The liquid is metered through a flow control facility, and thence into a dispenser which is adapted to introduce the liquid to a drum in a manner to avoid foaming action within the latter.

18 Claims, 4 Drawing Figures

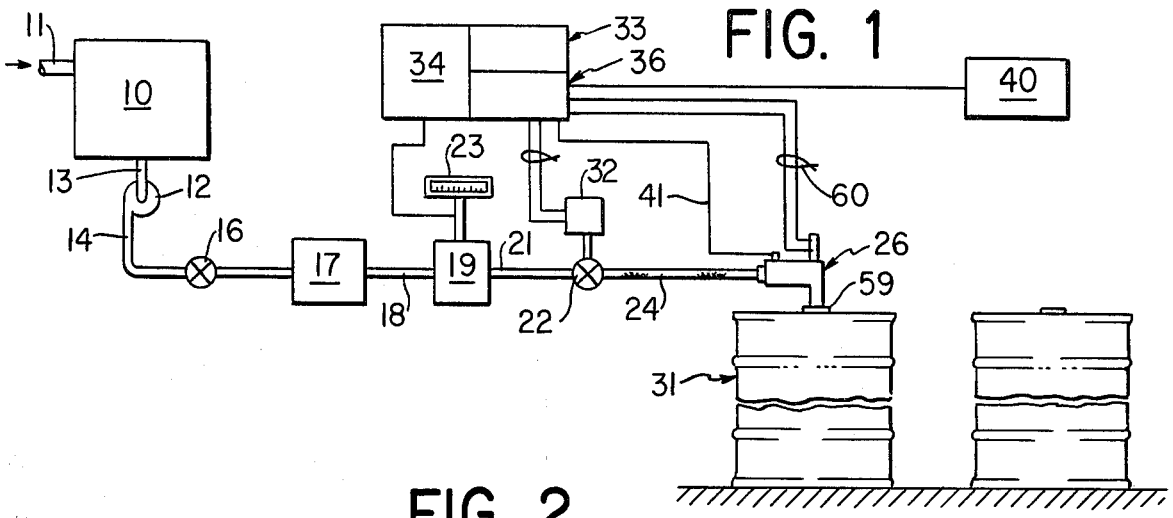
FIG. 1
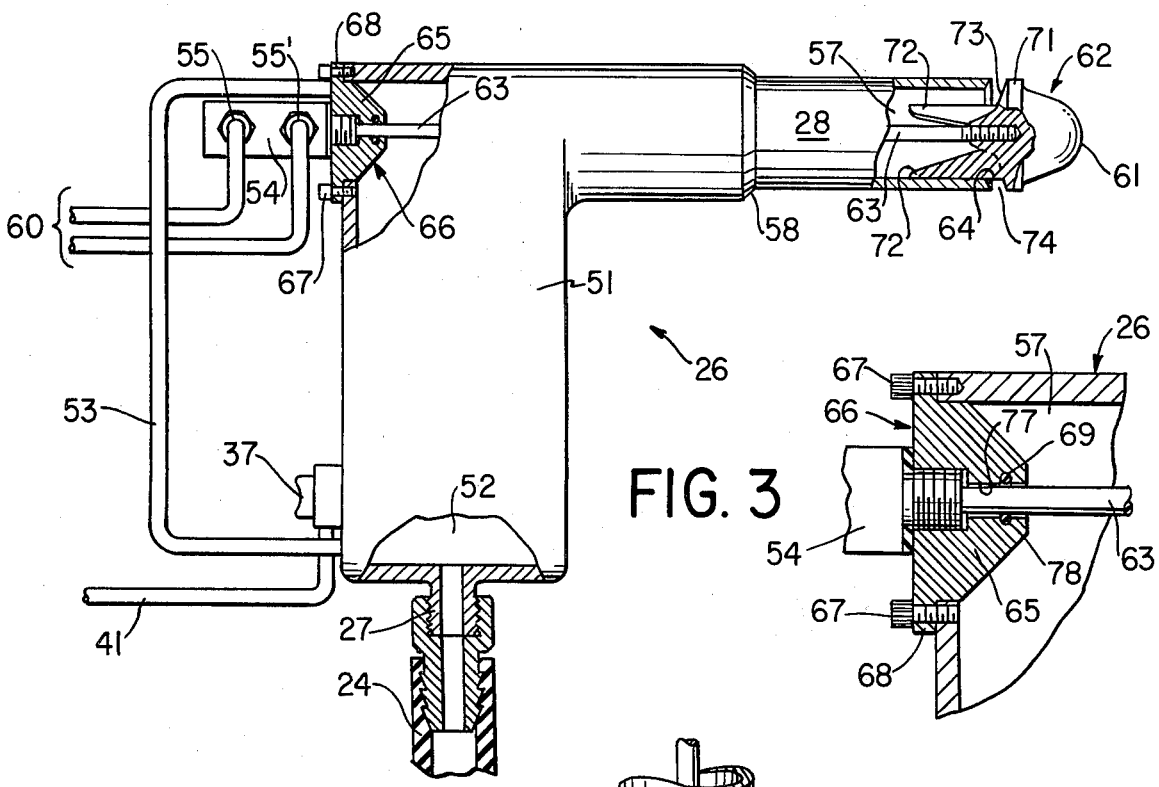
FIG. 2
FIG. 3
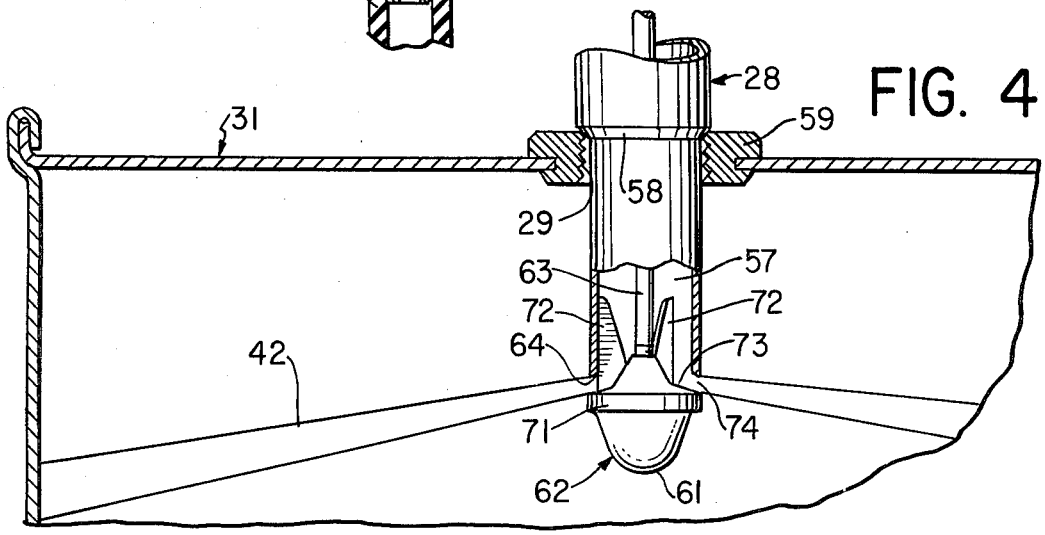
FIG. 4

METHOD AND APPARATUS FOR FILLING DISCRETE DRUMS WITH A LIQUID

BACKGROUND OF THE INVENTION

In the course of the normal metering of a liquid into a drum of barrel, a certain amount of foaming of the liquid will be experienced. The amount of foaming which takes place is normally a function of the character of the liquid as well as the temperature at which it enters the drum.

The foaming action is considerably fostered by the velocity at which incoming liquid strikes the surface of liquid already within the drum. However, even though the injecting nozzle which carries liquid into the drum is immersed beneath the surface of the contained liquid, there will still result a considerable amount of foaming.

In the filling of drums with a liquid such as lubricating oil, the characteristic of the liquid to foam during a filling action, represents a distinct disadvantge. For one thing, when a number of such drums are being filled it is necessary, as a matter of quality control, that they all have the required amount of liquid prescribed for the drum size. Preferably they will all contain equal amounts of the liquid inserted.

The usual commercial drum filling or liquid metering apparatus comprises basically, means for weighing the amount of liquid which is deposited into a drum. Thus, the weight of the combined liquid and the drum, can be monitored until a point is reached which indicates that the drum contains the prescribed amount of liquid.

During the rapid filling of drums with such a liquid as lubricating oil, there will be a strong tendency of the latter to foam within the drum depending on the pressure at which liquid is introduced. As a result, there will be a distinct propensity of the liquid to overflow through the drum's bung hole wherein the liquid carrying nozzle is normally positioned. The problem could be overcome or at least eased by reducing the flow rate at which the liquid enters the drum. This step, however, introduces an unfavorable time factor which will be reflected in the cost of the liquid.

An additional facet to be considered as above noted, drums of the type contemplated are normally filled on a weight basis. Here, the empty drum is initially positioned on a scale or other means for determining its tare weight. The filling operation then proceeds and is terminated at a point when the required amount by weight of liquid has been deposited into the drum.

Such a procedure requires that the drum then be closed by insertion of a cap member threaded into the bung opening. The drum must then be physically removed from the scale apparatus. Thereafter it can be conveyed or otherwise moved to where required. Movement of the filled drum under such circumstances is normally accomplished manually and has been found to result often times in injury to personnel due to both the awkwardness and weight of the filled drum.

Toward overcoming the above stated problems, the present invention provides a method and a metering system for liquids and particularly for relatively heavy liquids such as lubricating oil. The system includes means to both monitor, and to accurately regulate the volume of the liquid which transfers between the source thereof, and into a series of receptacles. A further feature of the system is that not only will the receptacles be efficiently loaded, but they will be provided with substantially identical quantities of the liquid being handled.

It is therefore an object of the invention to provide a liquid metering method and system, capable of rapidly dispensing substantially equal volumes of liquid into a series of receptacles. A further object is to provide a liquid metering method and system capable of dispensing the liquid while eliminating foaming action which would normally take place within the receiving receptacle. A still further object is to provide a liquid metering system of the type contemplated which includes a liquid dispensing nozzle adapted to introduce a high velocity stream of liquid into a closed receptacle while avoiding substantial foaming action within the receptacle.

The above objectives are achieved by provision of a liquid handling system which can be either automatically or manually operated. The system is capable of rapidly and sequentially metering equal amounts of the liquid into a series of containers such as drums or the like which normally include a single bung hole opening at the top side.

The present system is capable of utilizing or handling any number of liquids having varying characteristics, particularly those which exhibit a propensity for causing foaming when introduced rapidly into a receptacle. At least one liquid of the type which can be handled in the disclosed system is a conventional lubricating oil.

The latter is normally of a sufficient viscosity to readily flow when at reasonable operating temperatures between about 90° F. and 120° F. In the following description, the liquid being handled will be considered to be lubricating oil although no limitation as to the system's operating capabilities is to be inferred thereby. One species of such oil is characterized by a SUS viscosity at 100° F. of 450.

DESCRIPTION OF THE DRAWINGS

In the drawings,

FIG. 1 is a schematic representation of the presently disclosed liquid metering system.

FIG. 2 is a vertical elevation view in partial cross section of the nozzle used in the system.

FIG. 3 is an enlarged segmentary view of a part of the nozzle of FIG. 2.

FIG. 4 is an enlarged segmentary view of a nozzle disposed in a drum bung opening.

Referring to FIG. 1, the instant system is comprised of a source or reservoir 10 of liquid. The source can be a closed vat, tank or the like, having means communicated therewith to replenish the same with a quantity of lubricating oil as needed. The latter can be a conduit 11 which is in turn communicated to a primary source of the liquid such as the final stages of a refinery or other storage facility.

Source 10 is communicated with the suction side of a pump 12 by way of a conduit 13. Said pump 12 in one embodiment, is electrically driven and controlled by a switching mechanism or the like. The pump as herein noted, can be either manually or automatically operable to commence the drum filling procedure.

Operationally, pump 12 discharges an oil stream or flow through a conduit 14 by way of valve 16, into an air eliminator and strainer 17. The latter comprises primarily means to eliminate as much air as possible from the oil stream.

The downstream side of air eliminator 17 is communicated by way of conduit 18 with a flow monitoring or metering means 19 having an inlet which opens into a metering mechanism. The outlet or downstream side of the metering mechanism 19 is communicated by way of conduit 21 to a main flow control valve 22.

One function of metering means 19 is to accurately detect the volume of liquid which passes therethrough, and into conduit 21 and main flow control valve 22. Said metering means 19 further functions to create a signal in response to, and commensurate with such flow.

In response to the volume of oil passing through metering means 19 a visual display 23 is provided for readily reading said flow. In the present system, a digital display 23 is communicated with the metering means whereby said display affords a running, accurate read-out of the amount of liquid which has passed through the system.

From the main flow control valve 22, liquid flow is directed by way of an elongated flexible conduit 24 to the inlet of a dispensing nozzle 26. The latter will be described herein in greater detail, but comprises essentially an inlet means 27 for receiving liquid. The nozzle further includes a barrel 28 which registers within bung hole 29 of the drum 31 being filled.

Control of main flow valve 22 is achieved by a main valve actuator 32. In one embodiment the latter comprises a pneumatic powered means which engages the valve closure member, and which is communicated with a source of air. Valves of this nature which are pneumatically controlled are well known and often used for industrial applications.

Actuator 32 is powered by air pressure such that the valve 22 can be moved into either open or closed position whereby to permit, or to completely discontinue flow of liquid through conduit 24.

To regulate the disposition of main flow valve 22, a controller member 33 is provided. Said member includes means for receiving the signal which is generated in response to the flow volume through metering means 19.

Operationally, the volume control mechanism 34 is manually preset to allow an accurately measured flow of liquid to pass through main flow control valve 22. Thereafter, the latter will be automatically adjusted to closed position only at such time as the predetermined volume of liquid has passed through said valve 22. The air to actuate valve 22 is simultaneously transmitted to dispenser valve 62. The liquid flow period of mechanism 34, is in turn adjusted by the signal generating flow meter 19. By monitoring the flow volume of liquid as registered on digital read-out 23, timer 34 can be set to permit only the desired volume of liquid to pass through main control valve 22. When the predetermined volume has passed through metering means 19, main valve actuator 32 will be actuated to close said main flow valve.

The system liquid controlling operation is effectuated through an air valve complex 36 which is communicated with an air source 40. The latter is in turn communicated with volume controller 34, and with valve actuator means 32 to bring about the desired sequence of operation between volume controller 34, main control valve 22, and nozzle valve 62.

After main control valve 22 has been adjusted to closed position, liquid flow will simultaneously be discontinued at nozzle 26. This sudden flow interruption will cause no substantial damage to the nozzle or its valve structure. Thereafter, the nozzle can be manually relocated into the open bung 29 of another drum in anticipation of filling the latter.

Referring to FIG. 2, liquid flow to the empty drum is initiated by depressing valve button 37. The latter in turn functions through conduit 41 to close an air circuit communicated with controller 33. Control mechanism 34 is thereby reset to again open main flow control valve 22 as well as valve 26 and to reinitiate the liquid flow as herein noted.

With respect to nozzle 26, the latter comprises a body 51 having inlet opening 27 which is adapted to removably receive the end of flexible conduit 24. Said body 51 defines an internal chamber 52 into which the liquid is first introduced. The exterior of body 51 is provided with a handle or similar grasping means 53 to permit manipulation of the nozzle when the latter is moved about by hand rather than by mechanical means.

Body 51 is further provided with a rear mounting wall to which an air cylinder or air motor 54 is attached. Said cylinder 54 includes inlet and outlet means 55 and 55', respectively for communicating with air valve complex 36, through conduits 60. Nozzle 26 can thus be actuated to no-flow condition concurrently with the discontinuance of liquid flow through main valve 22.

Body 51 is provided at one end with an opening into which a barrel 56 communicably attaches. Said barrel 56 includes an elongated cylindrical member having a chamber 57 therein. The outer surface of barrel 56 includes a cylindrical wall which terminates at a peripheral seat or shoulder 58.

As shown in FIG. 4, the latter is preferably adapted to rest at the rim 59 of a bung hole 29. When properly positioned, barrel 56 will be uprightly registered in opening 29 for a drum filling operation.

To facilitate mounting of air cylinder 54 to body 51, the latter is provided with a cap 66 having screw connectors 67 which engage the body. Cap 66 is provided with a peripheral rim 68 together with a projecting portion 65 which extends into body chamber 57.

Referring to FIG. 4, the forward end of barrel 28 is provided with a flow guide element 62. Said element is slidably positioned within barrel 56 forward end and includes means to threadably engage an elongated connector rod 63.

Connector rod 63 extends coaxially of the barrel chamber 57 and engages the movable piston of air cylinder 54. Thus, actuation of air cylinder 54 will cause the connecting rod 63 to be reciprocated either forward or backward, thereby establishing the position of flow guide 62 with respect to the barrel end face 64.

The close fitting, yet slidable relationship between guide element 62 permits coaxial adjustment of said element with respect to end face or lip 64 of barrel 56. Thus, said end face 64, when spaced from the guide element 62, defines an annular, constricted discharge opening 74 though which the oil flows. As shown in FIG. 4, said opening 74 defines an outwardly divergent flow pattern of the oil stream. Said flow pattern is generally saucer-like of frusto-conical in nature such that the oil flow strikes the drum wall in a circular pattern adjacent to the drum top side.

Nozzle cap 66 is provided with an axial passage 77, having a threaded receptacle to receive the comparable threaded fitting of air cylinder 54. Said cap axial passage 77 is further provided with one or more annular grooves 78 to receive a peripheral seal ring 69 which slidably registers connecting rod 63 in a fluid tight sliding joint as the rod is reciprocally actuated through barrel 56. A generally conical point 71 is held in abutment with guide element 62, being threadably connected to the remote end of connecting rod 63.

Flow guide element 62 comprises a relatively flat base section 71 having a series of rearwardly projecting vanes 72 depending therefrom. Vanes 72, as shown, comprise three in number and are spaced radially equidistant apart to slidably and concurrently engate the inner surface of barrel 28.

A central threaded passage formed in guide 62 is adapted to receive the threaded end of elongated connecting rod 63. Thus, guide 62 can be adjusted longitudinally with respect to barrel 28 end face 64, in response to actuation of air cylinder 54.

Guide element 62 base section 71 is provided with a deflecting surface 73 which is adapted to receive the shaped drip point 61. The latter extends from the nozzle 26 forward end and permits oil to run smoothly from the nozzle when flow is discontinued.

The end of guide 62 is positioned such that by operation of air cylinder 54 to the advanced position, guide 62 will be urged forward of the barrel end face 64. Thus, said guide 62, together with the end face 64, define annular discharge opening 74 of variable length. The spacing width and disposition of the latter will govern to a large extent the flow pattern of the lube oil passing therethrough.

Deflecting face 73 formed on the inner surface of base member 71 is preferably comprised of a relatively smooth, generally frusto conical configuration. Thus, as liquid is forced under pressure through elongated barrel 28, it will strike the frusto conical deflecting face 73 and be urged radially outward from the discharge opening 74. The resulting flow pattern 42 of the oil at it is deflected outwardly, can be described generally as noted, as fan-like, conical, or even saucer-like.

In any event, the oil stream will emerge laterally from constricted discharge opening 74 at a relatively high velocity. The oil flow will then contact the inner side wall of drum 31 and flow downwardly along the cylindrical walls of the latter.

Since there will be no high velocity contact between incoming oil, and the oil pool which is already in the drum, there will be no splashing nor a tendency of the lube oil to foam up. Rather, there will be a relatively smooth and foam-free passage of the oil downwardly along the drum walls toward the pool.

As the level of oil rises within the drum approaching the filled stage, the outwardly directed fan-like liquid spray 42 will urge air within the drum upwardly and through bung hole 29. Air will thus be displaced upwardly and pass through the radial openings formed in the spray pattern by the rearwardly extending vanes 72.

As drum 31 becomes full, there will be no opportunity for air to be trapped at the upper end, which would tend to cause foaming action, or an overflowing of the oil. Further, it will be unnecessary for a filling operator to manipulate nozzle 26 to regulate oil flow. Said flow will be automatically controlled in response to passage of liquid as monitored through the metering means 19.

Thus, when a predetermined amount, often 55 gallons, has been introduced to a 55 gallon drum, main flow valve 22 will be automatically actuated to the closed position. With the concurrent actuation of air cylinder 54, guide element 62 will be drawn rearwardly to the closed position thereby closing discharge opening 74 and discontinuing flow from said opening.

Nozzle 26 is provided with a switch or pneumatic valve 37. The latter is communicated with controller 34 and valve complex 36 to conduit 41 to permit flow through the latter.

Since valve 37 is communicated with the main air circuit to valve actuator 32, said valve 37 also functions as an emergency flow cut-off facility. Thus, flow can be discontinued by an operator at any time during a filling operation regardless of the condition of controller 34.

After nozzle 26 has been removed from the filled drum, it is reinserted into another similar capacity drum to continue the operation.

Filling of the next drum is reinitiated by depressing manually operated switch or valve 37. Such action causes the controller 34 air circuit to be reopened whereby valve actuator 32 will function to cause valve 22 to assume the open position.

It is clear that the simultaneous functioning of flow control valve 22 with nozzle closure member 62 assures that each drum will receive an equal amount of oil. The simultaneous valve actuation permits a set quantity of oil to be retained between the respective valves when the latter are closed. Further, closing of the nozzle valve will not result in a jolt on the nozzle as would ordinarily be expected since valve 22 will absorb the shock of sudden flow stoppage.

Although modifications and variations of the invention may be made without departing from the spirit and scope thereof, only such limitations should be imposed as are indicated in the appended claims.

We claim:

1. A system for depositing equal amounts of a liquid sequentially into a series of holding drums 31 from a pressurized source 10 of said liquid, which system includes;

flow monitoring means 19 communicated with said pressurized source of liquid 10 to receive a liquid flow from the latter, and to establish a first signal in response to a predetermined volume of liquid having passed therethrough, main flow valve means 22 communicated with said flow monitoring means 19 to receive said liquid flow, and said main valve means 22 including a signal responsive valve actuator 32 being operable to adjust said main flow valve 22 between open and closed positions, a discharge nozzle 26 including a controllable discharge opening 74, which is communicated with said main flow valve 22 to receive said liquid flow and to introduce the same to a holding drum 31, flow control means 34 mutually communicated with said metering means 19, with said signal responsive valve actuator 32, respectively, whereby to impress a signal into said actuator 32 for actuating said main flow valve 22 to closed position in response to a predetermined volume of liquid having passed through said metering means 19.

2. In a system as defined in claim 1, wherein said nozzle 26 includes; a control circuit communicated with said flow control means 34, and said control circuit being operable to actuate said valve actuator 32 prior to said signal being impressed on the latter.

3. In a system as defined in claim 2, wherein said control circuit includes; a manually operated switch 37 carried on said nozzle 26, and conductor means 60 communicating said switch 37 with said flow control means 34.

4. In a system as defined in claim 2, wherein said nozzle 26 includes; a guide element 62 which defines a variable discharge opening 74 for directing liquid from said nozzle 26 in a desired spray pattern.

5. In a system as defined in claim 4, wherein said nozzle 26 includes; a motor means 54, operably connected to said guide element 62, for adjusting the variable discharge opening 74 between opening and closed positions.

6. In a system as defined in claim 5, wherein said motor means 54 is connected to said first flow control means 34, whereby said motor means 54 is actuated by said control means concurrently with actuation of said valve actuator 32.

7. Method for rapidly transferring a predetermined amount of liquid into a drum 31, from a source 10 holding said liquid, which method includes the steps of;

initiating a flow of the liquid from said source 10 through a signal actuated main flow valve 22 and thence to a liquid dispensing nozzle 26 having an adjustable discharge port 74 positioned in communication with said drum 31, monitoring the volumetric flow of said liquid which passes a point intermediate said source 10 and said dispensing nozzle 26, to establish a signal when said predetermined amount of liquid has flowed past said point, and impressing said signal on said signal actuated main flow valve 22 to actuate the latter into closed position and thereby to interrupt liquid flow therethrough when said predetermined amount of liquid has flowed into said drum 31.

8. Method as defined in claim 7, including the step of; forming the liquid flow into a dispersed pattern as the liquid leaves the nozzle 26 discharge port 74.

9. Method as defined in claim 7, including the step of; forming the liquid flow into an outwardly flaring, frusto conical pattern as said flow leaves the nozzle 26 discharge port 74.

10. Method as defined in claim 7, including the step of; forming said liquid flow into a dispersed pattern to impinge against walls of said drum 31 in a generally ring-like area of contact about said walls.

11. Method as defined in claim 9, wherein said frusto conical flow pattern is characterized by an included angle of between 150° and 180°.

12. Method as defined in claim 9, wherein said frusto conical flow pattern is characterized by an included angle of between 180° and 170°.

13. Method as defined in claim 10, wherein said flow impinging area of contact about the drum is disposed radially outwardly from the nozzle discharge port 74.

14. Method as defined in claim 7, including the step of; forming said liquid into a frusto conical spray pattern to impinge against the drum 31 wall prior to the said liquid contacting liquid already contained in the drum.

15. Method as defined in claim 7, wherein said drum embodies a cover, and a bung hole 29 formed therein, including the step of; registering said dispensing nozzle 26 in substantially upright position in said bung hole 29.

16. Method as defined in claim 15, wherein said bung hole 29 is disposed substantially centrally of said drum cover.

17. A system for depositing equal amounts of a liquid sequentially into a series of holding drums 31 from a pressurized source 10 of said liquid, which system includes;

flow monitoring means 19 communicated with said pressuried source of liquid 10 to establish a liquid flow from the latter, and to establish a first signal in response to a predetermined volume of liquid having passed therethrough, main flow valve means 22 communicated with said flow monitoring means 19 to receive said liquid flow, and said main valve means 22 including a signal responsive valve actuator 32 being operable to adjust said main flow valve 22 between opened and closed positions, a discharge nozzle 26 including an end face, and a controllable discharge opening 74 which is communicated with said main flow valve 22 to receive said liquid flow and to introduce the same to a holding drum 31, flow control means 34 mutually communicating said metering means 19, with said signal responsive valve actuator 32, and with said discharge opening 74 respectively, whereby to impress a signal into said actuator 32 for actuating said main flow valve 22 to closed position in response to a predetermined liquid flow through said metering means 19, and for concurrently actuating said controlled discharge opening 74 to closed position.

18. In a system as defined in claim 17, wherein said controlled discharge opening 74 includes; a guide element 62 slidably positioned in said nozzle, and means for urging said guide element into liquid sealing engagement with said nozzle end face.

* * * * *